US005458556A

United States Patent [19]

Hlubik

[11] Patent Number: 5,458,556

[45] Date of Patent: Oct. 17, 1995

[54] BAG WITH REINFORCED INTEGRAL HANDLE PORTIONS

[75] Inventor: Katherine C. Hlubik, Jacobstown, N.J.

[73] Assignee: Duro Bag Manufacturing Company, Ludlow, Ky.

[21] Appl. No.: 281,371

[22] Filed: Jul. 27, 1994

[51] Int. Cl.[6] ..... B31B 1/26

[52] U.S. Cl. ..... 493/231; 493/244; 493/245; 493/264; 493/267; 493/405; 493/926

[58] Field of Search ..... 493/231, 243, 493/244, 245, 260, 261, 264, 267, 408, 405, 926; 383/10, 17, 20, 27

[56] References Cited

U.S. PATENT DOCUMENTS 1,355,353 10/1920 Pease .
1,661,143 2/1928 Littman .
2,650,016 8/1953 McMillan .
3,416,720 12/1968 Kleinhaut .
3,454,441 7/1969 Spruyt .
3,605,570 9/1971 Goodwin .
3,776,108 12/1973 Nock ..... 229/39 R
4,174,657 11/1979 Suominen .
4,221,321 9/1980 Langen et al. ..... 229/54 R
4,906,228 3/1990 Reifenhauser et al. ..... 493/926
5,102,383 4/1992 Achelpohl et al. .

*Primary Examiner*—Bruce M. Kisliuk
*Assistant Examiner*—Eileen P. Morgan
*Attorney, Agent, or Firm*—Dennis H. Lambert

[57] ABSTRACT

Methods of manufacturing bags preferably from a single sheet of bag forming material and bags produced thereby having reinforced handle sections integral with the wide sides of the bag.

16 Claims, 3 Drawing Sheets

BAG WITH REINFORCED INTEGRAL HANDLE PORTIONS

TECHNICAL FIELD

The present invention is directed to the manufacture of a bag, such as used for grocery shopping, having reinforced handles integral with the sides of the bag.

BACKGROUND OF THE PRIOR ART

Conventional paper or plastic bags are of general rectangular configuration with handles or gripping portions at the upper end thereof. When fully loaded or laden with heavy objects, a great deal of stress is placed on the handle portions which can result in tearing of the bag or the disengagement of the handles from the bag itself.

Efforts have therefore been made to reinforce the handles and/or to make the handle portions capable of bearing the weight of the contents of the bag. Examples of such efforts are disclosed in C. S. Pease, U.S. Pat. No. 1,355,353; Z. Littman, U.S. Pat. No. 1,661,143; H. I. McMillan, U.S. Pat. No. 2,650,016; S. Kleinhaut, U.S. Pat. No. 3,416,720; L Spruyt, U.S. Pat. No. 3,454,441; R. C. Goodwin, U.S. Pat. No. 3,605,570; and F. Achelpohl et al., U.S. Pat. No. 5,102,383.

The bags manufactured by the methods described in the abovementioned references are disadvantageous because they do not provide sufficient support for bags fully loaded with heavy objects. In particular such bags provide inadequate support in vicinity of the handle portions of the bag where stress from the weight of the contents of the bag is the greatest. Such bags often experience failure at the handle portions when the contents of the bag exceeds about 5 pounds.

It would therefore be a significant advance in the manufacture of paper and plastic bags to provide a construction which allows weights exceeding 5 pounds and preferably up to about 20 pounds. Such bags would provide the added benefit of reducing the number of bags needed to carry groceries and the like by a typical consumer.

SUMMARY OF THE INVENTION

The present invention is generally directed to methods of manufacturing paper and plastic bags, preferably from a single sheet of paper or plastic, with reinforced handle sections sufficient to support up to 20 pounds of weight. The bags produced by these methods have handle sections integral with opposed sides of the bags and are formed by producing multiple layers of paper or plastic with each layer adhesively bonded to another layer.

More specifically, the present invention is directed to methods of manufacturing a bag of substantially rectangular shape formed by opposed wide sides, narrow sides and a base with reinforced handle sections of predetermined height integral with the wide sides of the bag, and to bags produced by these methods.

The methods comprise forming opposed flap portions from the opposed narrow sides. The flap portions are then folded onto the respective wide sides of the bag and bonded thereto by an adhesive or other bonding means to form respective wide side reinforced sections. The resulting wide side reinforced sections are each folded upon themselves and bonded thereto to form respective prehandle sections having sufficient strength to support up to 20 pounds of weight under normal carrying conditions.

The prehandle section is then provided with an opening capable of receiving a hand therethrough. The resulting reinforced handle section is integral with the respective wide sides of the bag and therefore can not be disengaged from the bag under typical conditions of use.

BRIEF DESCRIPTION OF THE DRAWINGS

The following drawings in which like reference characters indicate like parts are illustrative of embodiments of the invention and are not intended to limit the invention as encompassed by the claims forming part of the application.

FIGS. 2A–2F are perspective views in sequence showing a first embodiment of the present invention wherein:

FIG. 2A shows the narrow side of the bag cut to form respective flap portions;

FIG. 2B shows the flap portions extended prior to folding;

FIG. 2C shows the flap portions folded upon themselves and bonded to form respective wide side reinforced sections;

FIG. 2D shows the wide side reinforced sections diagonally folded and bonded upon themselves and together forming a triangular shaped section;

FIG. 2E shows the triangular shaped section folded downwardly upon itself and bonded to form a prehandle section; and FIG. 2F shows an opening in the prehandle section to form the desired reinforced handle section allowing the user to grip the bag with the hand; and FIGS. 3A–3E are perspective views in sequence showing a second embodiment of the invention wherein;

FIG. 3A shows the narrow sides and a portion of the wide sides of the bag cut to form flap portions;

FIG. 3B shows the flap portions extended prior to folding;

FIG. 3C shows the flap portions folded upon themselves and bonded to form respective wide side reinforced sections;

FIG. 3D shows a wide side reinforced section folded downwardly upon itself and bonded to form a prehandle section; and FIG. 3E shows an opening in the prehandle section to form the desired reinforced handle section allowing the user to grip the bag with the hand.

DETAILED DESCRIPTION OF THE INVENTION

The present invention is directed to methods of making bags with reinforced handle sections which are integral with the wide sides of the bag. The bags which may be produced in accordance with the invention can be made from paper or plastic, and preferably from a single sheet of the same. Such materials of construction include, for example, Kraft paper, polyethylene, polypropylene, styrene-butadiene and the like.

Construction of the bags of the present invention begins with a conventional non-handled bag, preferably made from a single sheet of material. Respective portions of the sides of the bag are folded upon themselves and bonded to provide the desired reinforcement in the handle region. Bonding may be carried out with adhesives, such as commonly used for adhering sheets of heavy weight paper (e.g. kraft paper)

together. Alternative means of bonding include heat sealing and the like.

The bags produced in accordance with the present invention are constructed so that the reinforced handle sections can withstand up to a 20 pound load under normal conditions of use. In a first embodiment of the invention the bag is produced by forming first flap portions solely from the narrow sides of the bag.

Figure 1:
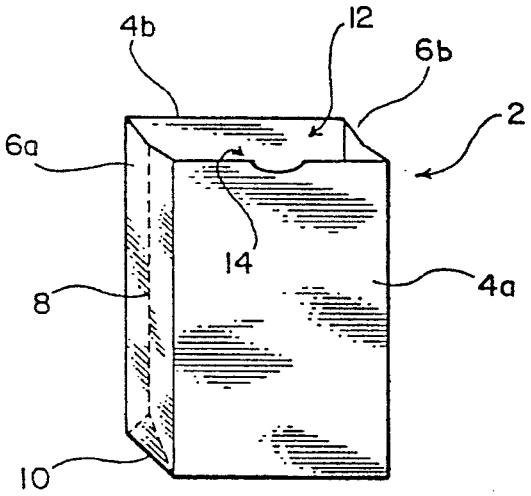
FIG. 1 (PRIOR ART)
FIG. 1 is a perspective view of a conventional bag without handles which may be used to make the bag of the present invention.

Referring to FIG. 1 there is shown a conventional non-handled bag 2 having opposed wide sides 4*a* and 4*b* and opposed narrow sides 6*a* and 6*b*. A fold 8 is present in the narrow sides along the median thereof enabling the bag 2 to be folded in a conventional manner. The bag 2 has a bottom section 10 and an opposed opening 12 defining a substantially rectangular shaped storage area 14.

Figure 2A:
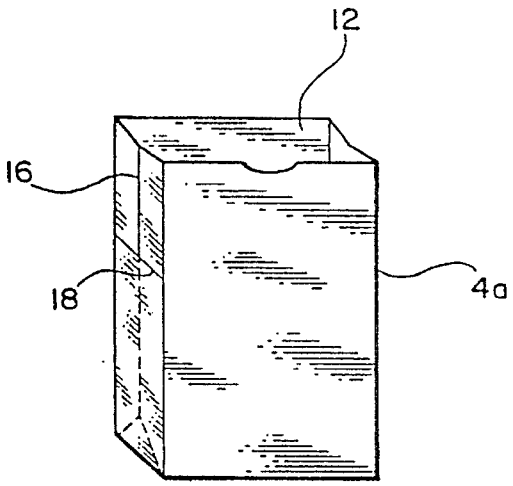

As a first step in forming the bag of the present invention the narrow side 4*a*, as shown specifically in FIG. 2A, is cut to a depth shown by the line 16. The line 16 is preferably along the median of the narrow sides 6*a* and 6*b*. The depth of the cut corresponds to the desired height of the reinforced handle portion which will be formed integral with the wide side 4*a* of the bag 2. It should be noted that all future reference will be made to only one of the wide sides 4*a* and to only one of the narrow sides 6*a*. All operations performed on these sides of the bag will also be performed on the corresponding sides 4*b* and 6*b* to provide a bag with opposed reinforced handle sections.

Figure 2B:
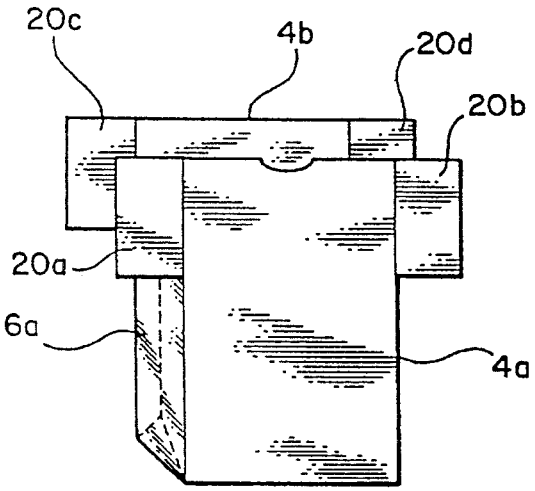

Once the narrow side 6*a* is cut to the desired depth, a second cut, indicated by line 18 is made substantially perpendicular to the cut 16 toward the wide side 4*a* of the bag 2. Cutting both narrow sides 6*a* and 6*b* in this manner results in the formation of four flap portions 20*a*–20*d* as shown specifically in FIG. 2B. When the cut 16 is made along the median of the narrow sides 6*a* and 6*b*, the four flap portions 20*a*–20*d* have the same dimensions. In this preferred embodiment of the invention, there is provided uniform and symmetrical handle sections as described hereinafter.

Figure 2C:
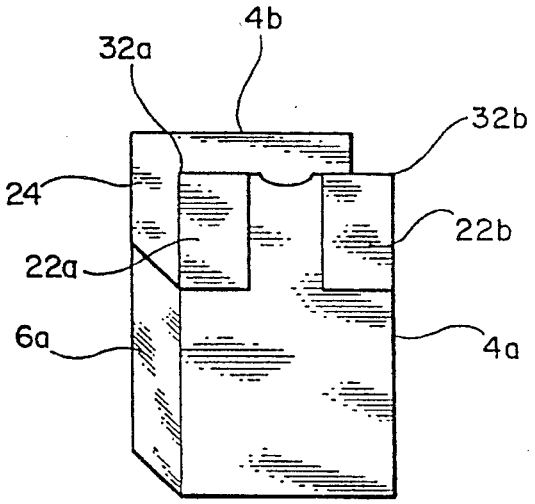

Each of the respective flap portions (only 20*a* and 20*b* are shown for convenience) are folded upon themselves and bonded to form respective wide side reinforced sections 22*a* and 22*b* as shown in FIG. 2C. In a preferred embodiment and as specifically shown in FIG. 2C, the flap portions 20*a* and 20*b* are folded so they lie on the outer surface of the wide side 4*a*. Folding the flap portion in this manner results in an opening 24 formed in the narrow side 6*a*. Thus, the distance from the bottom 10 to the cut line 18 (see FIG. 2A) will be the height of the completed bag. Accordingly, the height of the starting bag shown in FIG. 1 for construction of the bag of the present invention should be selected to provide a suitable final storage volume.

Bonding of each of the respective flap portions 20*a* and 20*b* upon themselves is preferably carried out using an adhesive when the bag is constructed of paper. A preferred adhesive is an adhesive composition containing starch and water as principal components. In particular an adhesive composition for use in the present invention contains Pearl Starch (a starch manufactured by Staley Manufacturing Company), Keofilm 83 (a corn starch manufactured by the Hubinger Company) and water. The adhesive composition may also contain preservatives such as soda ash (e.g. Sodium Carbonate manufactured by Ashland Chemical Company), binding agents such as soap flakes (Excelsior Soap manufactured by Ashland Chemical Company), antimicrobial agents such as sodium o-phenylphenate tetrahydrate (Dowicide manufactured by Dow Chemical Company), and viscosity control agents such as caustic soda (manufactured by Dow Chemical Company). For plastic bags, bonding can be carried out by heat sealing each of the respective flap portions upon themselves.

Figure 2D:
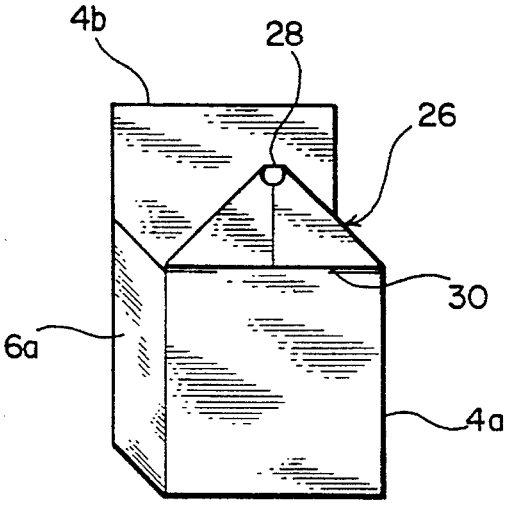
Figure 2E:
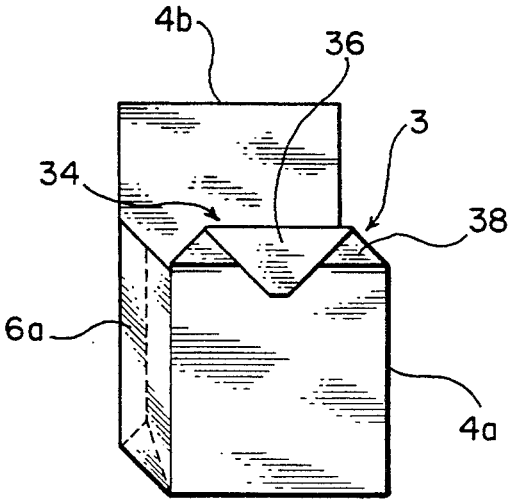

The flap portions 20*a* and 20*b* are then folded along the diagonal and bonded to form a triangular shaped section 26 having an apex 28 and a base 30 as shown in FIG. 2D. More specifically, the corners 32*a* and 32*b* of the respective flap portions 20*a* and 20*b* shown in FIG. 2C are folded toward each other until they abut or preferably slightly overlap along the base 30 as shown in FIG. 2D. The triangular shaped section 26 is then folded downwardly upon itself as shown in FIG. 2E. This is accomplished by taking the apex 28 and drawing it downwardly, preferably below the base 30, to form a prehandle section 34 having a flap 36 bonded to the remaining portion 38 of the triangular shaped section 26.

Figure 2F:
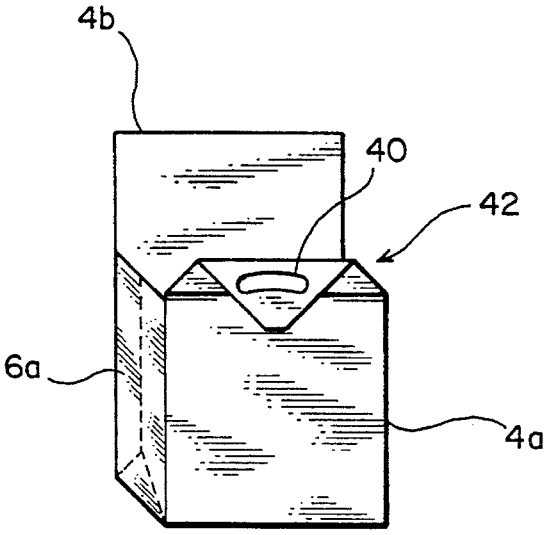

The final step of the process is shown in FIG. 2F. The prehandle section 34 is provided with an opening 40 which is of sufficient size to enable the user's hand to enter and grip the bag. The resulting reinforced handle section 42 is integral with the wide side 4*a* of the bag 2 and has sufficient strength to withstand up to 20 pounds of load.

The opening 40 is preferably centered within the prehandle section 34 so that any point of the perimeter of the opening 40 is an effective distance away from the edges of the flap portion 36. In addition, it is preferred that the opening be kidney shaped or other similar design having an arcuate perimeter which is less likely to tear from the stresses of a heavy load.

Figure 3A:
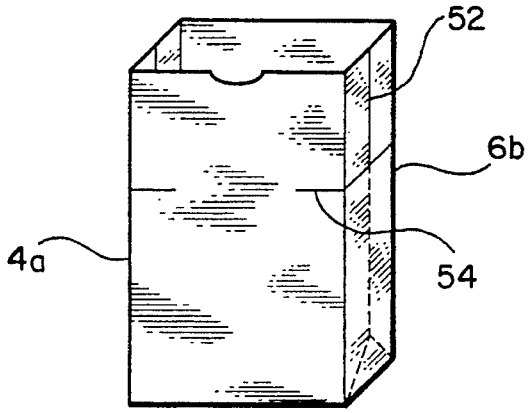
Figure 3B:
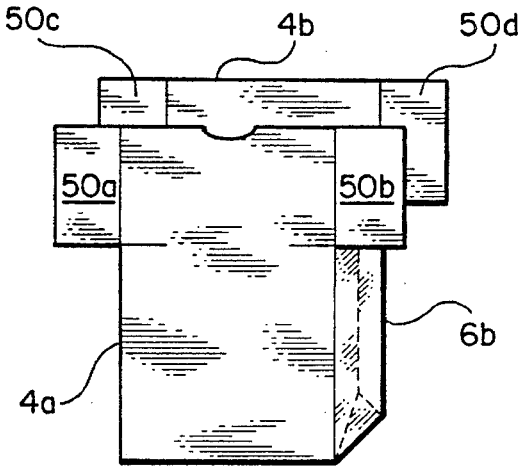

In a second embodiment of the invention, the flap portions are formed from the narrow sides and a portion of the wide sides of the bag. Referring to FIGS. 3A and 3B, the flap portions 50*a*–50*d* are formed by a cut 52 extending downwardly from the top of the bag, preferably along the median of the narrow sides and a cut 54 extending substantially perpendicular to the cut 52 and into a portion of the wide side 4*a* of the bag 2. Once cutting is complete, the resulting flap portions 50*a*–50*d* are extended as shown in FIG. 3B prior to folding.

Figure 3C:
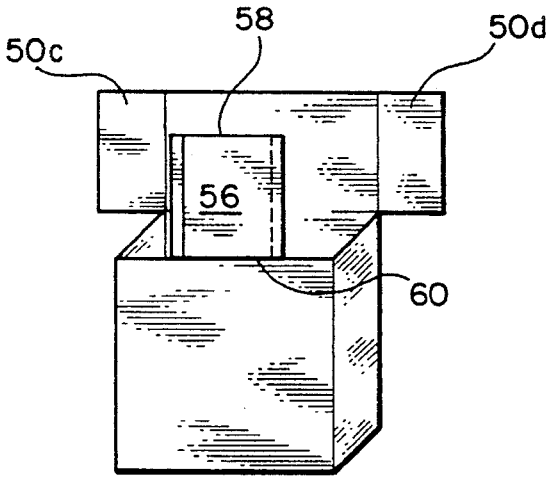
Figure 3D:
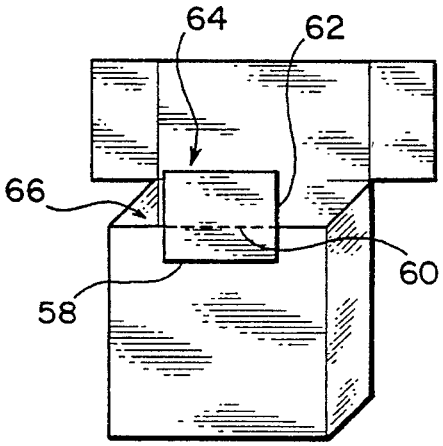

As shown in FIG. 3C the flap portions 50*a* and 50*b* are folded one onto the other and then bonded in that position with an adhesive or other bonding means as previously described to form a wide side reinforced section 56 having an upper edge 58 and a base 60. The upper edge 58 is then folded downwardly as shown in FIG. 3D until the upper edge 58 lies below the base 60. The folded flap portion 62 is then bonded to the remaining portion 64 of the wide side reinforced section 56 to form a prehandle section 66.

Figure 3E:
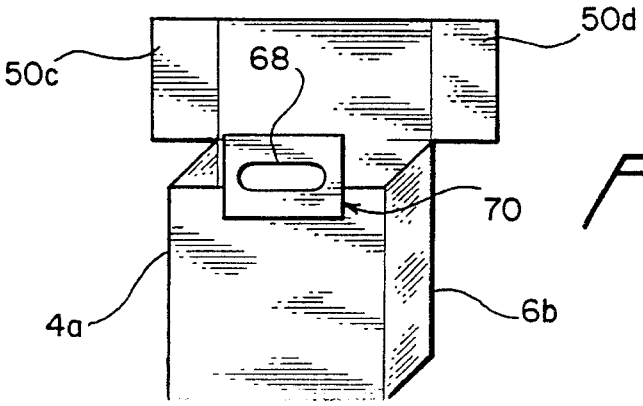

As shown in FIG. 3E, the prehandle section 66 is provided with an opening 68 of sufficient size to enable a user to insert a hand therein. The opening 68 is preferably centered in the prehandle section 66 to provide greater protection against tearing as previously described in connection with the embodiment of FIGS. 2A–2F. In this embodiment of the invention the opening is preferably oval shaped although a kidney shaped opening may also be employed. The resulting reinforced handle section 70 is capable of supporting up to 20 pounds of stress under normal conditions of use.

Once the bags are produced as described above the user inserts the hand through the openings of each reinforced handle section when the bag is loaded. The bag, containing up to 20 pounds, may be transported under normal conditions without tearing and without the handles becoming disengaged from the bag.

EXAMPLE

A standard size grocery bag without handles has a height of about 17⅛ inches and a narrow side of about 7 inches. When practicing the method of the present invention in accordance with FIGS. 2A–2F, the depth of the cut 16 should be about 6 inches and is made along the median of the narrow sides. As shown in FIG. 2D, it is preferred for the corners 32*a* and 32*b* to overlap each other by about ⅛ inch. The flap 36 produced as shown in FIG. 2E, preferably has a height of about 3 13/16 inches leaving the remaining portion of the triangular shaped section having a height of about 2 3/16. Accordingly, the flap 36 extends below the base 30 by approximately 1⅝ inches.

The opening 40 is preferably positioned in the prehandle section 34 so that at least ¼ inch separates the perimeter of the opening and the edge of reinforced handle section 42.

In the embodiment shown in FIGS. 3A–3E, the cut 54 preferably extends into the wide side 4*a* of the bag 2 by about 2⅜ inches. As shown specifically in FIG. 3D, the folded flap portion 62 extends below the remaining portion 64 of the prehandle section 66 by about 1⅝ inches. The opening 68 when in the form of an oval, preferably has a length of about 3 inches and a width of about 1 inch.

The embodiments described herein are for illustrative purposes only and variations thereof would be apparent to those of ordinary skill in the art of making paper and plastic bag without detracting from the spirit and scope of the invention.

I claim:

1. A method of manufacturing a bag of substantially rectangular shape formed by opposed wide sides, narrow sides and a base with reinforced handle sections of predetermined height integral with the wide sides, said method comprising:

(a) forming opposed flap portions from the opposed narrow sides;

(b) folding and bonding the flap portions onto the respective wide sides to form respective wide side reinforced sections;

(c) folding and bonding each of the wide side reinforced sections upon themselves to form respective prehandle sections; and (d) forming openings through the respective prehandle sections to thereby form said reinforced handle sections integral with the respective wide sides of the bag.

2. The method of claim 1 wherein the step of forming the opposed flap portions comprises a first cutting operation commencing at the top of the narrow sides and extending downwardly to a depth equal to the predetermined height of the reinforced handle section and a second cutting operation extending substantially perpendicularly through the narrow sides, parallel to the base and into a portion of the wide sides.

3. The method of claim 2 wherein the first cutting operation is made along the median of the narrow sides.

4. The method of claim 2 wherein the depth of the first cutting operation is about 6 inches.

5. The method of claim 1 wherein the narrow and wide sides have respective inner and outer surfaces, step (b) further comprising folding the opposed flap portions onto the outer surface of the wide sides of the bag.

6. The method of claim 1 wherein step (c) comprises diagonally folding and bonding each wide side reinforced section upon itself to form a substantially triangular shaped section having an apex and a base, and folding and bonding the triangular shaped section from the apex downwardly below the base to form the prehandle section.

7. The method of claim 6 wherein the step of forming the opposed flap portions comprises a first cutting operation commencing at the top of the narrow sides and extending downwardly to a depth equal to the predetermined height and a second cutting operation extending substantially perpendicularly from the first cut and parallel to the base to the wide sides.

8. The method of claim 7 wherein the first cutting operation is made along the median of the narrow side.

9. The method of claim 6 wherein the depth of the first cutting operation is about 6 inches.

10. The method of claim 6 wherein the narrow and wide sides of the bag have respective inner and outer surfaces, step (b) further comprising folding the first flap portions onto the outer surface of the wide sides of the bag.

11. The method of claim 1 wherein the openings through the prehandle sections have an arcuate perimeter.

12. The method of claim 1 wherein the opening through the prehandle sections are oval shaped.

13. The method of claim 1 comprising manufacturing said bag from a single sheet of a bag forming material.

14. The method of claim 13 wherein the bag forming material is paper or plastic.

15. The product produced by the method of claim 1.

16. The product produced by the method of claim 6.

* * * * *